United States Patent [19]

Yamazaki

[11] Patent Number: 4,731,314

[45] Date of Patent: Mar. 15, 1988

[54] PRINTING MEMBER FOR ELECTROSTATIC PRINTING HAVING A HIGH CRYSTALLIZATION REGION OF AN INTRINSIC SEMICONDUCTOR LAYER FORMED BY IRRADIATION WITH LIGHT AND METHOD OF MANUFACTURING THEREOF

[75] Inventor: Shunpei Yamazaki, Tokyo, Japan

[73] Assignee: Semiconductor Energy Laboratory, Co., Ltd., Kanagawa, Japan

[21] Appl. No.: 860,449

[22] Filed: May 7, 1986

[30] Foreign Application Priority Data

May 7, 1985 [JP] Japan ..... 60-96389
May 7, 1985 [JP] Japan ..... 60-96390

[51] Int. Cl.[4] ..... G03G 13/26

[52] U.S. Cl. ..... 430/49; 430/57; 430/84

[58] Field of Search ..... 430/57, 60, 67, 95, 430/84, 49

[56] References Cited

U.S. PATENT DOCUMENTS 4,526,849 7/1985 van der Voort et al. ..... 430/60
4,572,881 2/1986 Yamazaki ..... 430/67
4,632,894 12/1986 Ohashi et al. ..... 430/67

*Primary Examiner*—John L. Goodrow
*Attorney, Agent, or Firm*—Gerald J. Ferguson, Jr.; Michael P. Hoffman; Michael J. Foycik, Jr.

[57] ABSTRACT

A printing member for electrostatic photocopying including a substrate having a conductive surface; and a photoelectrically-sensitive, electrically chargeable layer on the conductive surface of the substrate; wherein the photo-electrically-sensitive, electrically chargeable layer has (a) a first layer member formed on the conductive surface of the substrate, the first layer member having a P or N or I type first non-single-crystal semiconductor layer or a first semi-insulating or insulating layer, (b) a second layer member formed on the first layer member, the second layer member being a first laminate member having an I type second non-single-crystal semiconductor layer and an I type third non-single-crystal semiconductor layer having a small energy band gap than that of the second non-single-crystal semiconductor layer, and (c) a third layer member formed on the second non-single-crystal semiconductor layer, the third layer member having an I type fourth non-single-crystal semiconductor layer having an equal to or larger energy band gap than that of the second non-single-crystal semiconductor layer, or a second semi-insulating or insulating layer, or a second laminate member having the fourth non-single-crystal semiconductor layer or second semi-insulating layer and the insulating layer; and wherein the third non-single-crystal semiconductor layer has a higher degree of crystallization than the second non-single-crystal semiconductor layer.

12 Claims, 9 Drawing Figures

PRINTING MEMBER FOR ELECTROSTATIC PRINTING HAVING A HIGH CRYSTALLIZATION REGION OF AN INTRINSIC SEMICONDUCTOR LAYER FORMED BY IRRADIATION WITH LIGHT AND METHOD OF MANUFACTURING THEREOF

BACKGROUND OF THE INVENTION

1. Field of the Invention

The present invention relates to a printing member for electrostatic photocopying, such as printing drum or plate.

2. Description of the Prior Art

Printing members for electrostatic photocopying are used to form on copying paper a visible image pattern corresponding to a photo or light image of the pattern to be copied in the manner described below.

The photocopying process starts with electrically charging the surface of the printing member uniformly all over it, onto which a photo or light image of the pattern to be copied is projected to form an electrostatic latent image. Then a toner powder is applied to the charged surface of the printing member for developing the latent image, and copying paper is pressed against the surface of the printing member to print a visible image pattern on the copying paper.

There has heretofore been proposed a printing member for electrostatic photocopying which comprises a substrate having a conductive surface and a photoelectric-sensitive, electrically chargeable layer formed on the conductive surface of the substrate. The photo-electrically-sensitive, electrically chargeable layer has a P type first non-single-crystal semiconductor layer, a first laminate member having an I type second non-single-crystal semiconductor layer and an I type third non-single-crystal semiconductor layer having a smaller energy band gap than that of the second non-single-crystal semiconductor layer, and an I type fourth non-single-crystal semiconductor layer having equal to or larger energy band gap than that of the second non-single-crystal semiconductor layer. In this instance, a P type first non-single-crystal semiconductor layer is formed of amorphous silicon (Si). The I-type second and third non-single-crystal semiconductor layers are formed of amorphous silicon and $Si_{1-x}Ge_x$ ($0<x<1$), respectively, With the conventional printing member of such a structure, the surface of the I-type non-single-crystal semiconductor layer of the chargeable layer forms the printing surface. When the chargeable layer, with its printing surface electrically charged positive, is exposed to a photo or light image of a pattern charged positive, is exposed to a photo or light image of a pattern to be copied, the light is absorbed mainly by a laminate member of the I-type second and third non-single-crystal semiconductor layers, with the result that photo carriers formed by electron-hole pairs are created chiefly in the laminate member. The electrons flow through the I-type fourth non-single-crystal semiconductor layer, neutralizing the positive charges on the printing surface. On the other hand, the holes flow through the P-type non-single-crystal semiconductor layer and reach the conductive surface of the substrate. In this way, the latent image pattern corresponding to the photo image pattern is formed in the conductive layer through such a mechanism as mentioned above. The two I type second and third non-single-crystal semiconductor layers of the laminate member by which the applied light is mainly absorbed have different energy band gaps of 1.7 to 1.9 and 1.2 to 1.5 eV, respectively. This permits the use of light over a wide range of wavelength from visible light to laser light for applying the photo or light image pattern to the chargeable layer.

In the case of the conventional printing member, however, the semiconductor layers making up the chargeable layer are all made of amorphous silicon and the I-type second and third non-single-crystal semiconductor layers are constituted of amorphous silicon and $Si_{1-x}Ge_x$ ($0<x<1$), respectively. Since the $Si_{1-x}Ge_x$ forming the I-type non-single-crystal semiconductor layer is poisonous, much care is necessary in handling the printing member. Moreover, the I-type third non-single-crystal layer can be produced by a CVD method through use of a material gas of $GeH_4$, $GeF_4$, or the like, but germanium for the material gas is not easily available and expensive; in addition, it is difficult to produce such a material gas. This means that the formation of the I-type third non-single-crystal semiconductor layer and accordingly the manufacture of the printing member is difficult, and the printing member becomes costly.

SUMMARY OF THE INVENTION

Accordingly, it is an object of the present invention to provide a novel printing member for electrostatic photocopying which is free from the aforesaid defects of the prior art.

In accordance with an aspect of the present invention, the printing member comprises a substrate having a conductive surface and a photoelectric-sensitive, electrically chargeable layer deposited on the conductive surface of the substrate. The electrically chargeable layer has (a) a first layer member formed on the conductive surface of the substrate, the first layer member having a P, N, or I type first non-single-crystal semiconductor layer or a first semi-insulating or insulating layer, (b) a second layer member formed on the first layer member, the second layer member being a first laminate member having an I type second non-single-crystal semiconductor layer and an I type third non-single-crystal semiconductor layer having smaller energy band gap than that of the second non-single-crystal semiconductor layer, and (c) a third layer member formed on the second non-single-crystal semiconductor layer, the third layer member having an I type fourth non-single-crystal semiconductor layer having equal to or larger energy band gap than that of the second non-single-crystal semiconductor layer, or a second semi-insulating or insulating layer, or a second laminate member having the fourth non-single-crystal semiconductor layer or second semi-insulating layer and the insulating layer. In this case the third non-single-crystal semiconductor layer has a higher degree of crystallization than does the second non-single-crystal semiconductor layer.

The first, second and third layer members, which make up the chargeable layer of the printing member of the present invention, respectively correspond to the P type first non-single-crystal semiconductor layer, the laminate member and the I-type fourth non-single-crystal semiconductor layer of the conventional printing member described above. Furthermore, the I-type second and third non-single-crystal semiconductor layers of the second layer member in the present invention respectively correspond to the I-type second and third non-single-crystal semiconductor layers of the prior art printing member. Accordingly, the printing member of the present invention is also able to form a latent image pattern corresponding to a photo image pattern on the printing surface formed by the surface of the chargeable layer through the same mechanism as in the prior art.

Moreover, since the I-type second and third non-single-crystal semiconductor layers have different energy band gaps, it is possible to employ, for irradiating the photo or light image pattern, light over a wide range of wavelength from visible light to laser light, as is the case with the conventional printing member.

In the printing member of the present invention, however, the difference in the energy band gap between the I type second and third non-single-crystal semiconductor layers is obtained in terms of the degree of crystallization. This permits the both layers to be formed of the same semiconductor material. For example, the second and third non-single-crystal semiconductor layers can be made of amorphous silicon and polycrystalline or microcrystalline silicon; there is no need of using the $Si_{1-x}Ge_x$ as in the prior art.

Accordingly, the present invention effectively obviates the afore-mentioned defects of the conventional printing member.

Other objects, features and advantages of the present invention will become more apparent from the following description taken in conjunction with the accompanying drawings.

DESCRIPTION OF THE PREFERRED EMBODIMENTS

Figure 1:
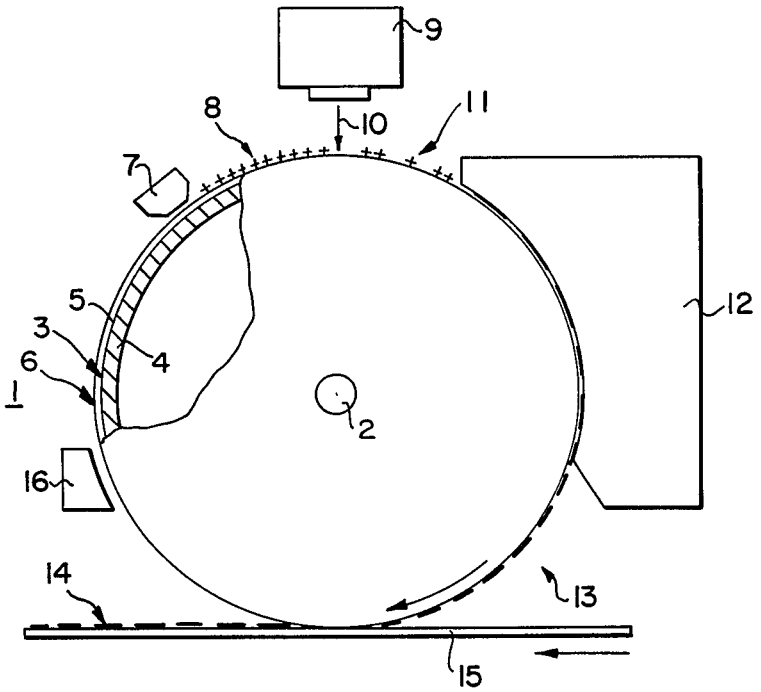
FIG. 1 is a schematic diagram explanatory of the principles of an electrostatic photocopying method using the printing member of the present invention.

FIG. 1 is a diagrammatic showing of the principles of the electrostatic photocopying method employing a printing member 1 of the present invention.

The printing member 1 is shown to be a drum 20 to 40 cm in diameter and 50 to 100 cm long, for example, and it is driven by a motor (not shown) coupled with a shaft 2. The printing drum 1 comprises a substrate 4 having a conductive surface 3 and a photoelectric-sensitive, electrically chargeable layer 5 deposited on the conductive surface 3. The construction of such a printing drum 1 is similar in appearance to conventional printing drums.

The electrostatic photocopying method using the printing drum 1 is common in principles to the prior art printing drums. Accordingly, a brief description will be given of the method.

The surface of the layer 5 and consequently a surface 6 of the printing drum is electrically charged, for example, positive uniformly by electrical charging means 7, positive charges being indicated by 8. Then a photo or light image 10 of a pattern is projected onto the drum surface 6 by photo or light image projecting means 9 disposed adjacent the drum 1, forming an electrostatic charge image 11 on the drum surface 6. The electrostatic charge 11 is obtained by such a mechanism as follows. When the light image 10 is projected onto the drum surface 6, there are created in the layer 5 at those areas irradiated by light electron-hole pairs in an amount corresponding to the intensity of incident light, the positive charges 8 on the drum surface 6 are neutralized by the electrons and the holes are directed to the conductive surface 3 of the substrate. After this, a toner (not shown) is applied to the drum surface 6 by developing means 12 disposed adjacent the drum 1, thereby developing the electrostatic charge image 11 to form a visible image pattern 13 on the drum surface 6. The visible image pattern 13 is obtained by such a mechanism that the toner sticks to the drum surface 6 at those areas where the charges forming the electrostatic charge image 11 lie, the amount of toner sticking to the drum being dependent on the charge intensity.

Next, copying paper 15 is fed to be pressed against the drum surface 6, printing the visible image pattern 13 on the copying paper 15 as indicated by 14.

Thereafter, the drum surface 6 is cleaned by cleaning means 16 disposed in contact with or in adjacent but spaced relation to the drum 1.

The drum surface 6 thus cleaned is electrically charged again by the electrical charging means 7 and thereafter it is subjected to the same processes as described above.

Figure 2A:
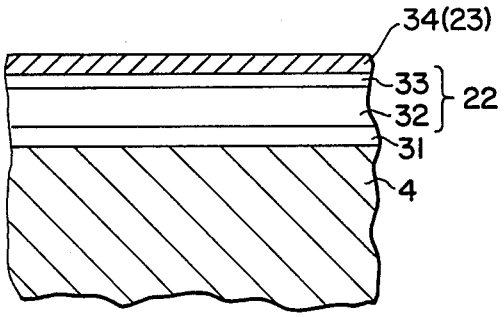
FIGS. 2A and 2B show a mechanical structure and an energy band structure of a first embodiment of the printing member of the present invention.
Figure 2B:
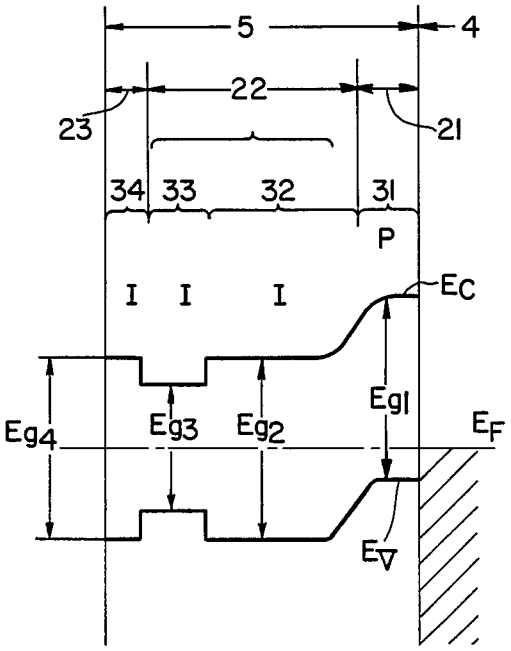

The printing member 1 is shown more in detail in FIGS. 2A and 2B.

As described above, the printing member 1 is provided with the substrate 4 having the conductive surface 3 and the photo-electric-sensitive, electrically chargeable layer 5.

The substrate 4 is formed of aluminum or like metal material.

The layer 5 is composed of first, second and third layer member 21, 22 and 23.

The first layer member 21 has a P type first non-single-crystal semiconductor layer 31 formed on the substrate 4. The P type layer 31 is formed amorphous Si, $Si_3N_{4-X}(0<X<4)$, $SiC_{1-X}(0<X<1)$, $SiO_{2-X}(0<X<2)$ or like.

The second layer member 22 is composed of an I type second non-single-crystal semiconductor layer 32 formed on the first layer member 21 and an I type third non-single-crystal semiconductor layer 33 formed on the I type second layer 32. The I-type second layer 32 is formed of the same amorphous semiconductor as the P type layer 31. The I type third layer 33 is formed of same semicondutor as the P type layer 31 but formed of a poly- or micro-crystal semiconductor, or a mixture of an amorphous semiconductor and a micro-crystal semiconductivity.

The third layer member 23 has a I type fourth non-single-crystal semicondutor layer 34 formed on the second layer member 22. The I type fourth layer 34 is formed of same amorphous semiconductor as the I type second layer 32.

Energy band gaps $Eg_1$, $Eg_2$, $Eg_3$ and $Eg_4$ of the first, second, third and fourth layers 31, 32, 33 and 34 bear such relationships $Eg_1 \simeq Eg_2 > Eg_3$, $Eg_3 < Eg_4$ as depicted in FIG. 2B. In FIGS. 2B, 4B, 5B, 6B, 7B, 7C, 8B and 9B, reference character $E_f$ represents the Fermi level, $E_C$ the bottom of a conductance band and $E_V$ the bottom of a valence band.

In the case where the first, second, third and fourth layers 31, 32, 33 and 34 are all formed of Si, however, the first, second and fourth layers 31, 32 and 34 are amorphous Si, but the third layer 33 is poly-crystal Si, the energy band gap $Eg_1$, $Eg_2$ and $Eg_4$ are 1.7 to 1.8 eV, and the energy gap $Eg_3$ is 1.4 to 1.5 eV.

A description will be given of the fabrication of the printing member 1 of the present invention.

The drum 4 is continuously driven at a speed of 0.1 to 1 r.p.s. by a motor (not shown) coupled with the shaft 2 in a vacuum chamber. The vacuum chamber is exhausted at all times by an exhausting pump. In such a state a cleaning gas such as, for example, Ar gas or a mixture gas of Ar and $H_2$ or the like is supplied into the vacuum furnace. At the same time, a predetermined voltage is applied across the electrodes opposing the substrate 4, thereby rendering the cleaning gas into a plasma to clean the conductive surface 3 of the substrate 4.

The substrate 4 is heated by heating means at a temperature between 200° and 400° C. and a semiconductor material gas or gases and a P type impurity material gas are introduced, along with a carrier gas such as helium gas, into the vacuum chamber. At this time, a predetermined DC voltage, which is superimposed on a high frequency voltage of a frequency between 0.01 and 50 MHz or between 1 and 10 GHz and of a power in the range of 100W to 1KW, is provided across the electrodes, to render the semiconductor material gas or gases, the P type impurity material gas and the carrier gas into plasma. As a result of this, the semiconductor material or material doped with the P type impurity material are deposited on the conductive surface 3 from the first P type layer 31. In the case the semiconductor material gas can be selected from the groups consisting of $SiH_4$, $SiH_2Cl_2$, $SiCl_4$ and $SiF_4$ gases, and $B_2H_6$ or $InC_3$ gas can be used as the P type impurity gas. In consequence, by suspension of supply the P-type impurity gas, the I type second and third layers 32 and 33 are formed in this order on the first layer 31.

Then, when the third layer 32 has been formed to a predetermined thickness, the introduction of the semiconductor material gas or gases into the vacuum chamber is stopped and, then, continuous or pulsed light obtainable with a xenon lamp, laser, or the like is applied to the second layer 32 to thermally anneal it at 700° to 1000° C. on its surface, thereby crystallizing the layer 33 to have a degree of crystallization in the range of from 2 to 98%. In this instance, when the I type second layer 32 contains a relatively large amount of oxygen, carbon, or nitrogen, in particular, oxygen, it is possible to effectively prevent the I type second layer 32 from being crystallized at the same time as the I type third layer 33 is crystallized.

Following this, the fourth layer 34 is formed in the same manner as in the case of the second layer 32.

In this way, the printing member 1 of the present invention described previously in respect of FIGS. 2A and 2B is obtained.

The printing member 1 of the first embodiment illustrated in FIGS. 2A and 2B exhibits the advantages referred to previously at the beginning of this specification.

Figure 3A:
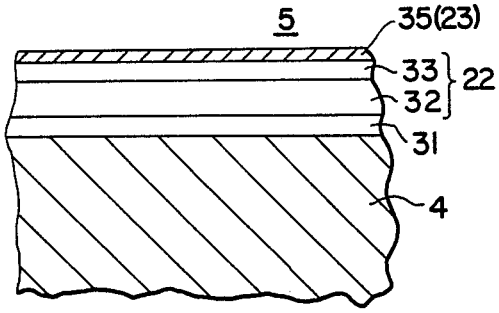
FIGS. 3A and 3B show a mechanical structure and an energy band structure of a second embodiment of the present invention.
Figure 3B:
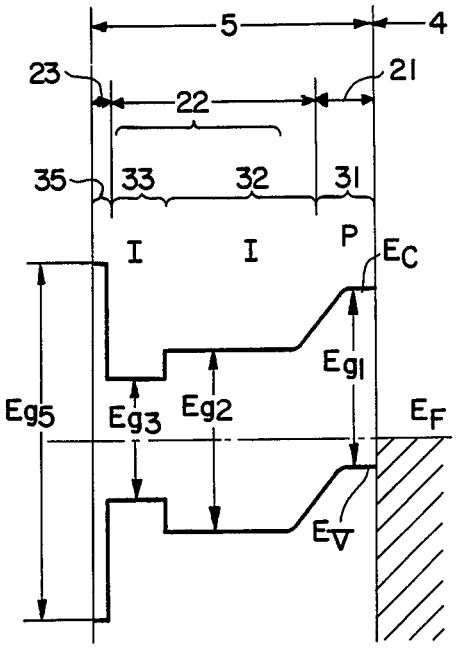

FIGS. 3A and 3B illustrate a second embodiment of the printing member of the present invention.

The parts corresponding to those in FIGS. 2A and 2B are identified by the same reference numerals and no detailed description will be repeated.

This embodiment is identical in construction with the embodiment of FIG. 2 except that the I-type fourth layer 34 is replaced with an insulating layer 35. The insulating layer 35 is a non-single-crystal semiconductor layer which is formed principally of amorphous $Si_3N_{4-x}$ $(0<x<4)$, $Si_{1-x}$ $(0<x<1)$ or the like. The insulating layer 35 is formed thin enough to permit the passage therethrough and electrical carrier (electrons) from the side the third layer 33 to the surface of the insulating layer 35, i.e. the surface 6 of the printing member 1. The energy band gap $Eg_5$ of the insulating layer 35 bear such relation $Eg_5 >> Eg_3$, $Eg_2$, $Eg_1$ as depicted in FIG. 3B.

The printing member 1 shown in FIGS. 3A and 3B can equally be produced by the similar method described previously with regard to FIGS. 2A and 2B; therefore, no detailed description will be repeated.

It will be appreciated that, though not described in detail, the printing member 1 shown in FIG. 3 also possesses the same advantages obtained with the printing member 1 of FIG. 2.

Figure 4A:
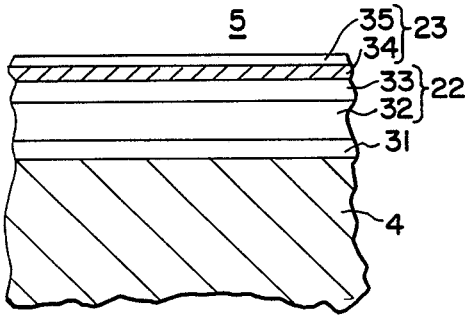
FIGS. 4A and 4B show a mechanical structure and an energy band structure of a third embodiment of the present invention.
Figure 4B:
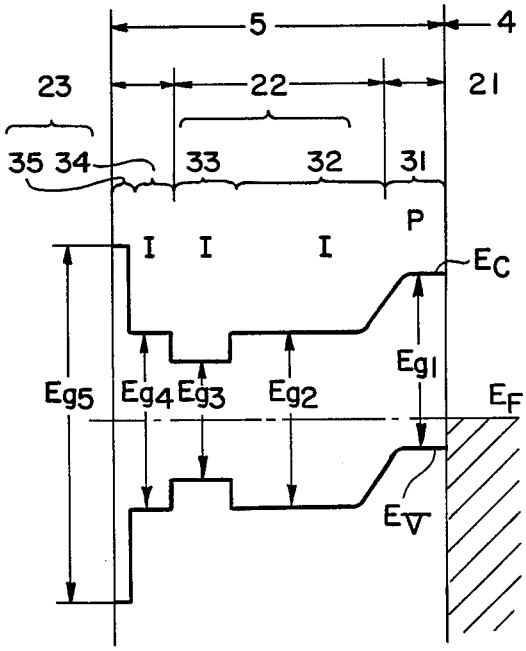

FIGS. 4A and 4B illustrate a third embodiment of the printing member 1 of the present invention.

The parts corresponding to those in FIGS. 2A and 2B are marked with the same reference numerals and no detailed description will be repeated.

This embodiment is also identical in construction with the embodiment of FIGS. 2A and 2B except that there are provided to the third layer member 23 the I-type fourth layer 34 as mentioned in FIG. 2 and the insulating layer 35 as mentioned in FIG. 3.

The printing member 1 of the embodiment shown in FIGS. 4A and 4B can be produced by the method described previously in connection with FIGS. 2A and 2B; accordingly, no detailed description will be repeated.

It is a matter of course that the printing member 1 depicted in FIGS. 4A and 4B also exhibits the advantages referred to previously with respect to FIGS. 2A and 2B.

Figure 5A:
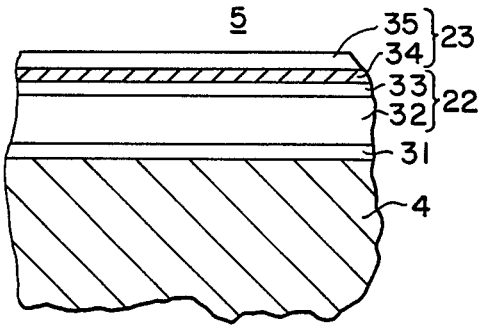
FIGS. 5A and 5B show a mechanical structure and an energy band structure of a fourth embodiment of the present invention.
Figure 5B:
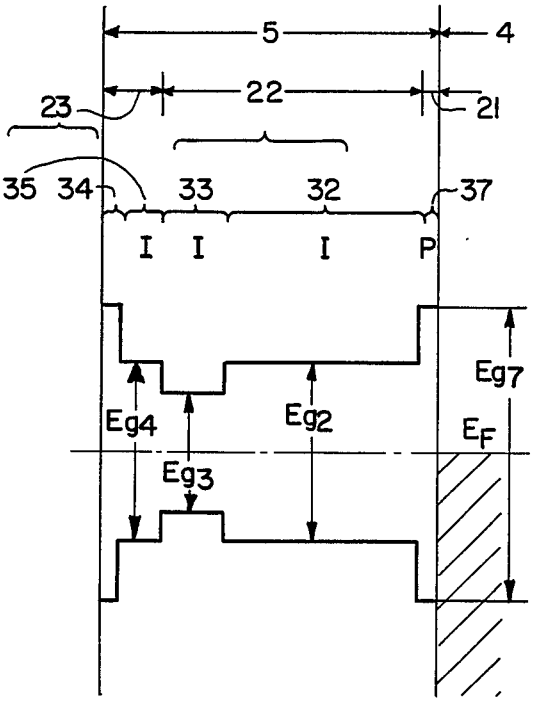

FIGS. 5A and 5B illustrate a fourth embodiment of the printing member 1 of the present invention.

The parts corresponding to those in FIGS. 4A and 4B indicated by the same reference numerals and no detailed description will be given.

This embodiment is identical in construction with the embodiment of FIGS. 4A and 4B except that the insulating layer 35 is substituted with a semi-insulating layer 36 and that the P-type first layer 31 is replaced with a semi-insulating layer 37.

The printing member 1 of this embodiment can be produced by the method described previously in respect of FIGS. 2A and 2B; therefore, no detailed description will be given.

It will be evident that the printing member 1 of this embodiment possesses the same advantages as those obtained with the embodiment described with regard to FIGS. 4A and 4B except that whether the printing surface, i.e. the surface of the semi-insulating layer 36 is charged positive or negative, the same effect as is obtainable with the embodiment of FIG. 4 is produced.

The foregoing embodiments should be construed as being merely illustrative of the invention and should not be construed in limiting sense. The semi-insulating layer in the above can be replaced with a insulating layer or the insulating layer can be replaced with a semi-insulating layer.

It will be apparent that many modifications and variations may be effected without departing from the scope of the novel concepts of this invention.

What is claimed is:

1. A printing member for electrostatic photocopying, comprising:

a substrate having a conductive surface; and a photo-electrically-sensitive, electrically chargeable layer on the conductive surface of the substrate;

wherein the photo-electrically-sensitive, electrically chargeable layer has (a) a first layer member formed on the conductive surface of the substrate, the first layer member having a P or N or I type first non-single-crystal semiconductor layer or a first semi-insulating or insulating layer, (b) a second layer member formed on the first layer member, the second layer member being a first laminate member having an I type second non-single-crystal semiconductor layer and an I type third non-single-crystal semiconductor layer having smaller energy band gap than that of the second non-single-crystal semiconductor layer, and (c) a third layer member formed on the second non-single-crystal semiconductor layer, the third layer member having an I type fourth non-single-crystal semiconductor layer having equal to or larger energy band gap than that of the second non-single-crystal semiconductor layer, or a second semi-insulating or insulating layer, or a second laminate member having the fourth non-single-crystal semiconductor layer or second semi-insulating layer and the insulating layer; and wherein the third non-single-crystal semiconductor layer has a higher degree of crystallization than does the second non-single-crystal semiconductor layer.

2. A printing member according to claim 1 wherein the third non-single-crystal semiconductor layer is formed of the same semiconductor material as that of the second non-single-crystal semiconductor layer.

3. A printing member according to claim 2 wherein the second and third non-single-crystal semiconductor layers are formed of Si, $Si_3N_{4-x}$ ($0<x<4$), $SiC_{1-x}$ ($0<x<1$), or $SiO_{2-x}$ ($0<x<2$).

4. A printing member according to claim 1 wherein the third non-single-crystal semiconductor layer is formed of a semiconductor material different from but having a larger energy band gap than the second non-single-crystal semiconductor layer.

5. A printing member according to claim 4 wherein the second non-single-crystal semiconductor layer is formed of $Si_3N_{4-x}$ ($0<x<4$), $SiC_{1-x}$ ($0<x<1$), or $SiO_{2-x}$ ($0<x<2$), and the third non-single-crystal semiconductor layer is formed of Si.

6. A printing member according to claim 2 or 4 wherein the second non-single-crystal semiconductor layer is formed of an amorphous semiconductor, and the third non-single-crystal semiconductor is formed of a poly- or micro-crystal semiconductor or a mixture of an amorphous semiconductor and a micro-crystal semiconductor.

7. A manufacturing method of a printing member for electrostatic photocopying comprising the steps of:

(a) preparing a substrate having a conductive surface;

(b) forming a first layer member on the substrate, the first layer member having a P, N or I type first non-single-crystal semiconductor layer or a first semi-insulating layer;

(c) forming a second layer member on the first layer member, the second layer member being a first laminate member having I-type second and third non-single-crystal semiconductor layers;

(d) crystallizing the third non-single-crystal semiconductor layer so as to have a larger energy band gap than that of the second non-single-crystal semiconductor layer by light annealing; and (e) forming a third layer member on the second layer member, the third layer member having an I type fourth non-single-crystal semiconductor layer having equal to or larger energy band gap than that of the second non-single-crystal semiconductor layer, or a second semi-insulating or insulating layer, or a second laminate member having the fourth non-single-crystal semiconductor layer and insulating layer.

8. A manufacturing method of a printing member according to claim 7, wherein the third non-single-crystal semiconductor layer is formed of the same semiconductor material as that of the second non-single-crystal semiconductor layer.

9. A manufacturing method of a printing member according to claim 8, wherein the second and third non-single-crystal semiconductor layer are formed of Si, $Si_3N_{4-x}$ ($0<x<4$), $SiC_{1-x}$ ($0<x<1$), or $SiO_{2-x}$ ($0<x<2$).

10. A manufacturing method of a printing member according to claim 7, wherein the third non-single-crystal semiconductor layer is formed of a semiconductor material different from but having a larger energy band gap than the second non-single-crystal semiconductor layer.

11. A manufacturing method of a printing member according to claim 10, wherein the second non-single-crystal crystal semiconductor layer is formed of $Si_3N_{4-x}$ ($0<x<4$), $SiC_{1-x}$ ($0<x<1$), or $SiO_{2-x}$ ($0<x<2$), and the third non-single-crystal semiconductor layer is formed of Si.

12. A manufacturing method of a printing member according to claim 8 or 10, wherein the second non-single-crystal semiconductor layer is formed of an amorphous semiconductor, the third non-single-crystal semiconductor layer is formed of an amorphous semiconductor and then annealed for crystallization into poly- or micro-crystal semiconductor, or a mixture of the amorphous semiconductor and a micro-crystal semiconductor.

* * * * *